US007852184B2

(12) United States Patent
Yamazaki et al.

(10) Patent No.: US 7,852,184 B2
(45) Date of Patent: Dec. 14, 2010

(54) COIL MODULE APPARATUS

(75) Inventors: Manabu Yamazaki, Kanagawa (JP); Kuniharu Suzuki, Tokyo (JP); Katsuya Suzuki, Gunma (JP); Hiroshi Kato, Kanagawa (JP); Yoichiro Kondo, Nagano (JP); Kota Onishi, Aichi (JP); Kentaro Yoda, Nagano (JP); Mikimoto Jin, Nagano (JP)

(73) Assignees: Sony Ericsson Mobile Communications Japan, Inc., Tokyo (JP); Seiko Epson Corporation, Tokyo (JP)

( * ) Notice: Subject to any disclaimer, the term of this patent is extended or adjusted under 35 U.S.C. 154(b) by 99 days.

(21) Appl. No.: 12/153,935

(22) Filed: May 28, 2008

(65) Prior Publication Data

US 2008/0297295 A1 Dec. 4, 2008

(30) Foreign Application Priority Data

May 29, 2007 (JP) ..... 2007-141690

(51) Int. Cl.
*H01F 38/12* (2006.01)

(52) U.S. Cl. ..... 336/84 M

(58) Field of Classification Search ..... 336/65, 336/83, 84 R, 84 M, 84 C, 200, 232; 320/108
See application file for complete search history.

(56) References Cited

U.S. PATENT DOCUMENTS

| | | | | |
|---|---|---|---|---|
| 5,375,040 | A * | 12/1994 | Cooper et al. | 361/730 |
| 6,473,304 | B1 * | 10/2002 | Stevens | 361/704 |
| 6,636,140 | B2 * | 10/2003 | Fujiyoshi et al. | 336/200 |
| 7,495,414 | B2 * | 2/2009 | Hui | 320/108 |
| 7,545,336 | B2 * | 6/2009 | Naito | 343/788 |
| 2008/0197957 | A1 * | 8/2008 | Kondo et al. | 336/90 |

FOREIGN PATENT DOCUMENTS

| | | |
|---|---|---|
| JP | 2006-339329 | 12/2006 |

* cited by examiner

*Primary Examiner*—Tuyen Nguyen
(74) *Attorney, Agent, or Firm*—Rader, Fishman & Grauer PLLC

(57) ABSTRACT

A coil module apparatus is provided. The coil module apparatus includes a flat coil, a circuit board, a magnetic sheet, connection terminals, and a case. The flat coil has a flat shape. The circuit board is used for the flat coil. The magnetic sheet is provided so as to cover one surface portion of the flat coil. The connection terminals are provided for connecting the flat coil and the circuit board. The case encloses the flat coil, the circuit board, and the magnetic sheet and encloses the connection terminals so that the connection terminals are partly exposed.

17 Claims, 16 Drawing Sheets

COIL MODULE APPARATUS

CROSS REFERENCES TO RELATED APPLICATIONS

The present invention contains subject matter related to Japanese Patent Application JP 2007-141690 filed in the Japanese Patent Office on May 29, 2007, the entire contents of which being incorporated herein by reference.

BACKGROUND OF THE INVENTION

1. Field of the Invention

The present invention relates to a coil module apparatus suitably applied to a contactless power transferring coil that carries out contactless charging of a charged appliance such as a mobile phone unit, a PHS (Personal Handyphone System) telephone, a PDA (Personal Digital Assistant), a mobile game device, a digital camera apparatus, a notebook personal computer or the like. In particular, the present invention relates to a coil module apparatus which, by assembling a flat coil that has been made slim into a module, has improved resistance to bending and improved strength and can be easily installed in a charged appliance.

2. Description of the Related Art

Japanese Unexamined Patent Application Publication No. 2006-339329 discloses a flat coil apparatus for contactless power transferring so as to obtain a sufficiently slim apparatus (see pages 7 to 8 and FIG. 1). With this flat coil apparatus, a spiral coil is formed so as to be disposed on a circuit board and a so-called return conductor formed in a direction that traverses the coil in the radial direction from the center to the outer periphery is formed by a printed circuit on the circuit board. By using a printed circuit as the return conductor, it is possible to minimize the thickness of the flat coil apparatus, and to make the entire flat coil apparatus sufficiently slim.

SUMMARY OF THE INVENTION

However, when using a slim coil such as one in the flat coil apparatus disclosed in Japanese Unexamined Patent Application Publication No. 2006-339329, resistance to bending and strength for the flat coil apparatus may be reduced.

Further, in the flat coil apparatus disclosed in Japanese Unexamined Patent Application Publication No. 2006-339329, the flat coil itself remains exposed. Accordingly, the process of incorporating the flat coil apparatus into a charged appliance such as a mobile appliance may be complicated.

It is desirable to provide a coil module apparatus capable of maintaining the resistance to bending and the strength of a coil that has been made slim and of being easily incorporated in an appliance.

According to an embodiment of the invention, there is provided a coil module apparatus. The coil module apparatus includes: a flat coil having a flat shape; a circuit board for the flat coil; a magnetic sheet provided so as to cover one surface portion of the flat coil; connection terminals for connecting the flat coil and the circuit board; and a case that encloses the flat coil, the circuit board, and the magnetic sheet and encloses the connection terminals so that the connection terminals are partly exposed.

According to an embodiment of the invention, the flat coil is assembled into a module by enclosing the flat coil and the like inside a case. By enclosing the flat coil inside the case, it is possible to obtain the resistance to bending and the strength of the flat coil. In addition, by assembling the flat coil into a module, the flat coil can be incorporated in a charged appliance in a simplified manner.

According to an embodiment of the invention, since the flat coil and the like are incorporated in a case and therefore the resistance to bending and the strength of the flat coil can be obtained. Also, since the flat coil is assembled into a module, the flat coil can be incorporated in a charged appliance in a simplified manner.

DESCRIPTION OF THE PREFERRED EMBODIMENTS

Embodiments of the present invention can be applied to a coil module apparatus that realizes a contactless charging function when incorporated in a mobile phone unit.

First Embodiment

Construction of Coil Module Apparatus

Figure 1:
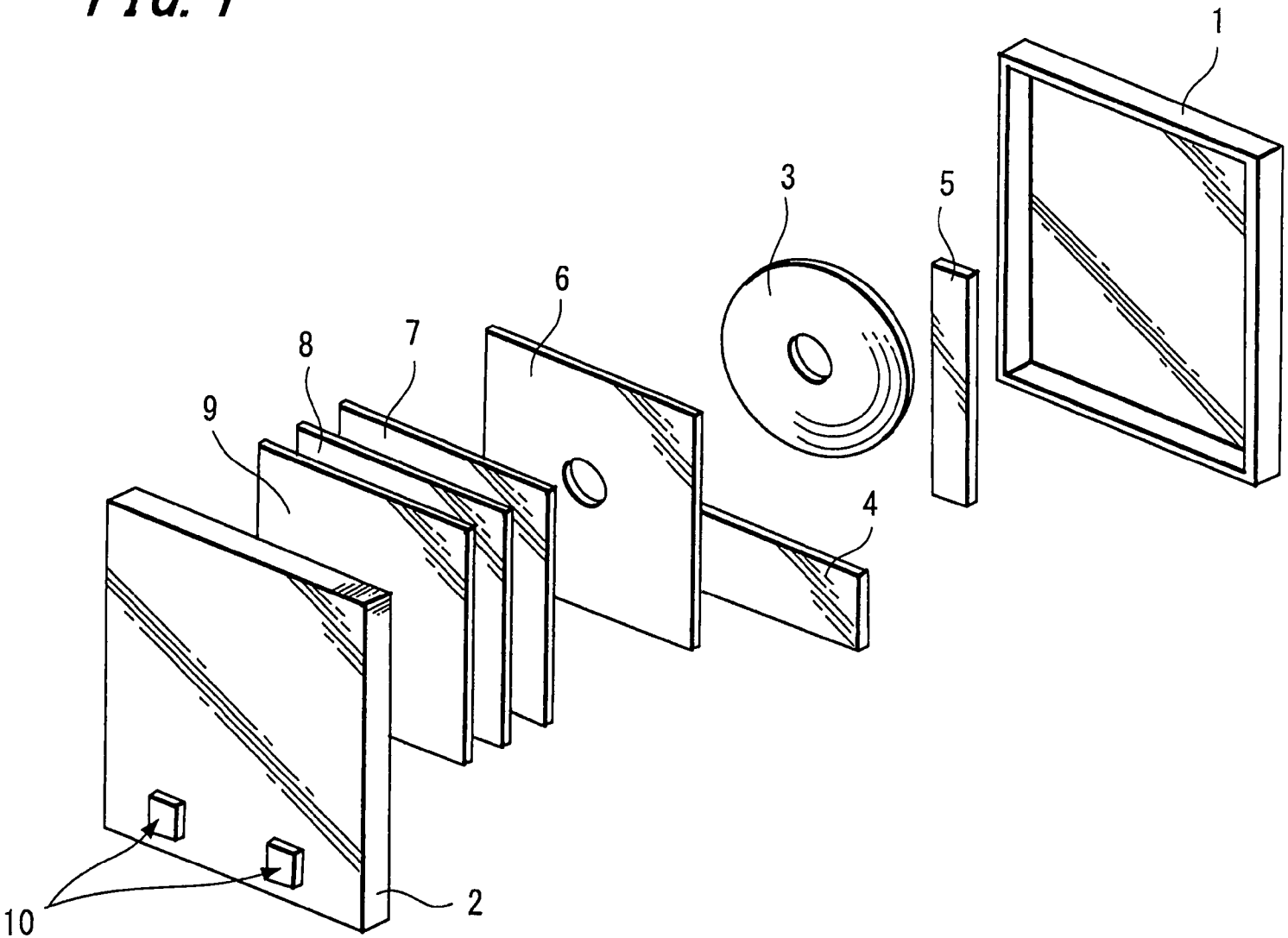
FIG. 1 is an exploded perspective view of a coil module apparatus according to a first embodiment of the present invention.
Figure 2:
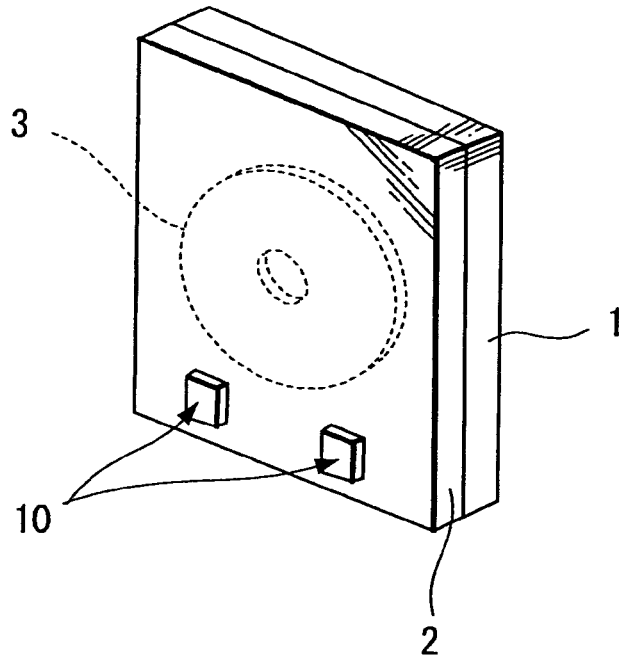
FIG. 2 is a perspective view of a coil module apparatus according to the first embodiment of the present invention.

FIG. 1 is an exploded perspective view of a coil module apparatus according to a first embodiment of the present invention and FIG. 2 is a perspective view of the coil module apparatus according to the first embodiment after assembly. As can be understood from FIG. 1 and FIG. 2, the coil module apparatus according to the present embodiment includes a first case piece 1, a second case piece 2 and a secondary side transfer coil 3. The first case piece 1 and second case piece 2 are formed of ABS (Acrylonitrile Butadiene Styrene copolymer) resin or the like and form an internal enclosure when placed facing one another and connected to one another. The secondary side transfer coil 3 has a flat shape and charges a battery pack of the mobile phone unit based on transfer power transferred from a primary side transfer coil of a cradle apparatus during contactless charging.

The coil module apparatus further includes a circuit board 4, a temperature sensor 5, a double-sided tape sheet 6, and a magnetic sheet 7. The circuit board 4 carries out charging control during contactless charging, control over the transmission and reception of predetermined data, and the like. The temperature sensor 5 detects the temperature of the secondary side transfer coil 3 during contactless charging. The double-sided tape sheet 6 is provided so as to cover the secondary side transfer coil 3 from the opposite side to the first case piece 1. The magnetic sheet 7 is stuck onto the secondary side transfer coil 3 via the double-sided tape sheet 6 so as to cover the secondary side transfer coil 3.

The coil module apparatus further includes a double-sided tape sheet 8 and a metal sheet 9. The double-sided tape sheet 8 is stuck onto the magnetic sheet 7. The metal sheet 9 is stuck onto the secondary side transfer coil 3 via the double-sided tape sheet 8 and the magnetic sheet 7 so as to cover the secondary side transfer coil 3. That is, the magnetic sheet 7 and the metal sheet 9 are stuck in that order on the secondary side transfer coil 3 via the double-sided tape sheet 6 and the double-sided tape sheet 8, respectively.

Connection terminals 10 are provided on the second case piece 2 and when the coil module apparatus is attached to the mobile phone unit, the connection terminals 10 are connected to connection terminals provided on the mobile phone unit for the electrical continuity of the secondary side transfer coil 3, the circuit board 4, and the temperature sensor 5.

The first case piece 1 and the second case piece 2 are placed facing one another and connected to one another with the components from the secondary side transfer coil 3 to the metal sheet 9 enclosed therein and by doing so, a rectangular box-shaped coil module apparatus as shown in FIG. 2 is formed.

Construction of the Secondary Side Transfer Coil

Figure 3:
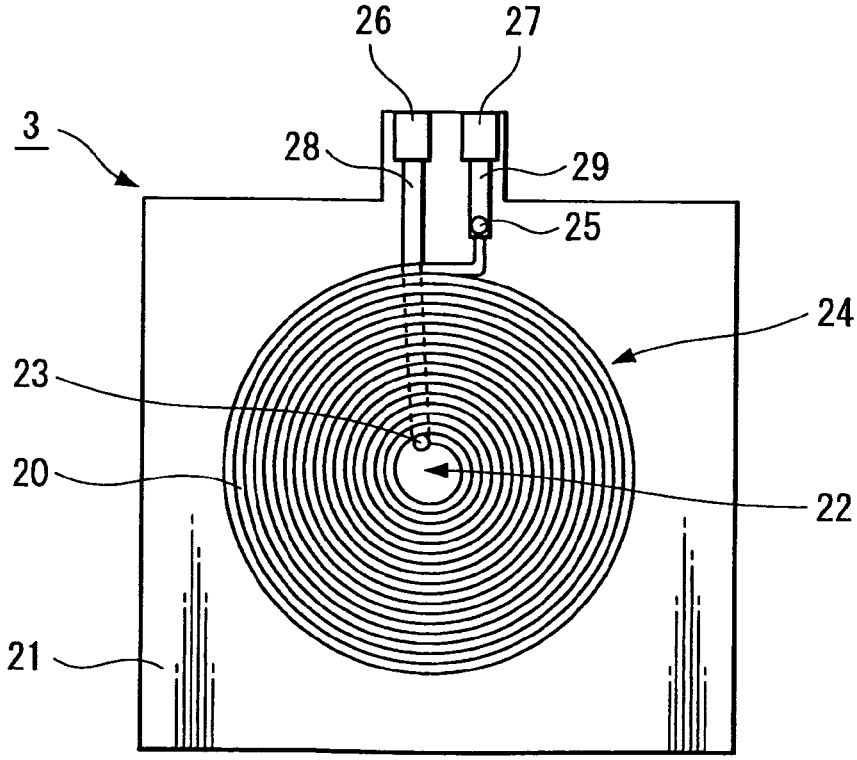
FIG. 3 is a view used for explaining a flat coil formed using a wire.

As shown in FIG. 3, the secondary side transfer coil 3 is formed by sticking a flat coil, which is produced by winding a wire 20 such as a solid wire or stranded wire with an insulating layer formed on the surface thereof into a spiral on a substantially flat plane, via an adhesive sheet onto a flexible printed circuit board 21.

The flexible printed circuit board 21 is an extremely thin sheet-like circuit board made of a material such as polyimide resin and has a surface insulating layer formed thereon. The surface insulating layer is formed on the surface excluding a first coil connecting portion 23, a second coil connecting portion 25, and a first external connection terminal portion 26, and a second external connection terminal portion 27. The first coil connecting portion 23 is located inside an inner periphery portion 22 of the flat coil when the flat coil has been stuck to the flexible printed circuit board 21. The second coil connecting portion 25 is located in a periphery outside an outer periphery portion 24 of the flat coil when the flat coil has been stuck to the flexible printed circuit board 21.

The first coil connecting portion 23 and the first external connection terminal portion 26 are electrically connected via a first internal wiring pattern 28 formed under the surface insulating layer. Similarly, the second coil connecting portion 25 and the second external connection terminal portion 27 are electrically connected via a second internal wiring pattern 29 formed under the surface insulating layer.

When the flat coil is stuck onto the flexible printed circuit board 21, a winding start portion in the inner periphery portion 22 is electrically connected to the first coil connecting portion 23 and a winding end portion of the outer periphery portion 24 is electrically connected to the second coil connecting portion 25. With this construction, the secondary side transfer coil 3 has no parts where the wire 20 overlaps itself, so that the thickness of the secondary side transfer coil 3 can be made extremely thin.

The magnetic sheet 7 and the metal sheet 9 are stuck via the double-sided tape sheet 6 and the double-sided tape sheet 8 respectively on the opposite surface of the secondary side transfer coil 3 to the surface on the first case piece 1-side. The magnetic sheet 7 and the metal sheet 9 are provided to efficiently form magnetic paths for the secondary side transfer coil 3 to increase the magnetic flux during contactless charging and also suppress unnecessary radiation due to magnetic fields produced during contactless charging.

Alternative Construction of the Secondary-Side Transfer Coil

Figure 4:
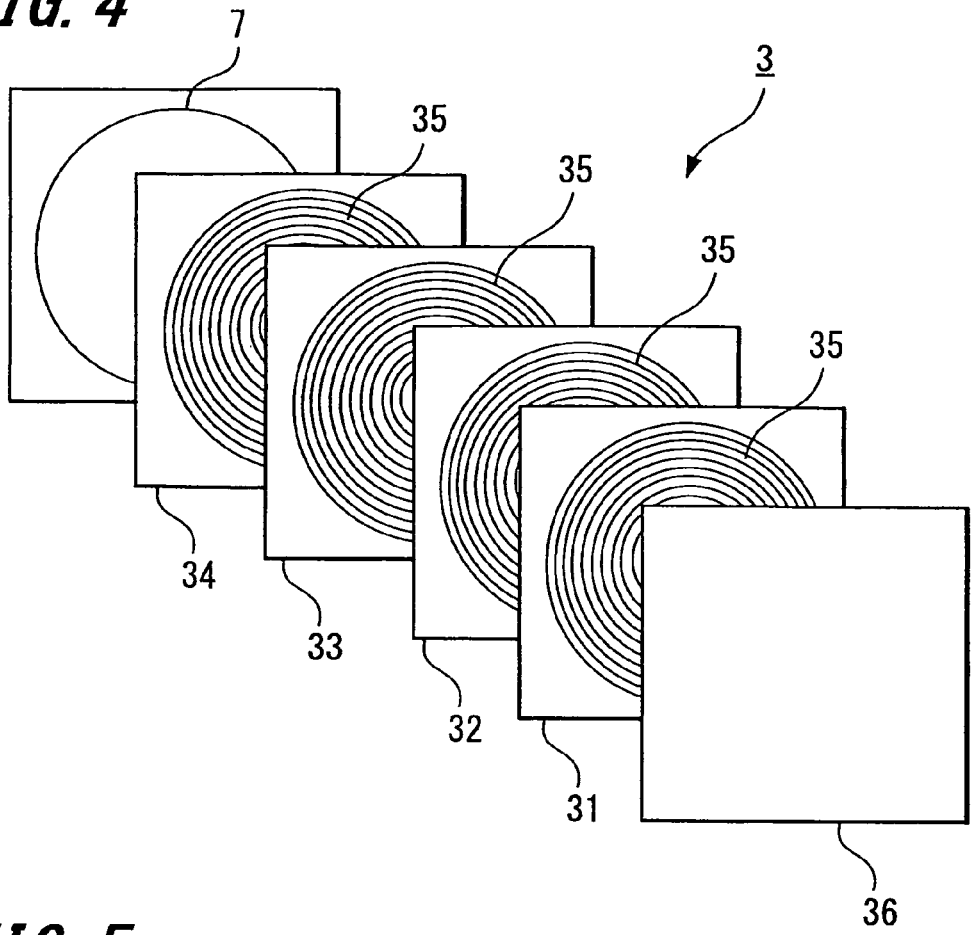
FIG. 4 is an exploded perspective view of a flat coil with a multilayer structure formed by stacking a plurality of flexible printed circuit boards on which conductive patterns are formed.

As shown in FIG. 4, a flat coil with a multilayer structure formed by stacking a plurality of flexible printed circuit boards on which flat coil patterns made of spiral conductive patterns have been formed may be used as the secondary side transfer coil 3 other than a flat coil formed using the wire 20 as shown in FIG. 3.

In this case, the secondary side transfer coil 3 includes a four-layer structure. For example, a first layer circuit board 31, a second layer circuit board 32, a third layer circuit board 33, and a fourth layer circuit board 34 are respectively formed of wiring conductive patterns 35 that have been wound in spirals on sheet-like circuit boards of a material such as polyimide resin.

A surface insulating layer 36 is formed on a surface of the first layer circuit board 31 as a topmost layer, and an adhesive layer and an insulating interlayer are formed in between the first layer circuit board 31 and the second layer circuit board 32. In the same way, an adhesive layer and an insulating interlayer are formed in between the second layer circuit board 32 and the third layer circuit board 33 and an adhesive layer and an insulating interlayer are formed in between the third layer circuit board 33 and the fourth layer circuit board 34. The magnetic sheet 7 and the metal sheet 9 are stuck onto the rear surface of the fourth layer circuit board 34 that is the bottommost layer via an adhesive layer and an insulating interlayer.

Figure 5:
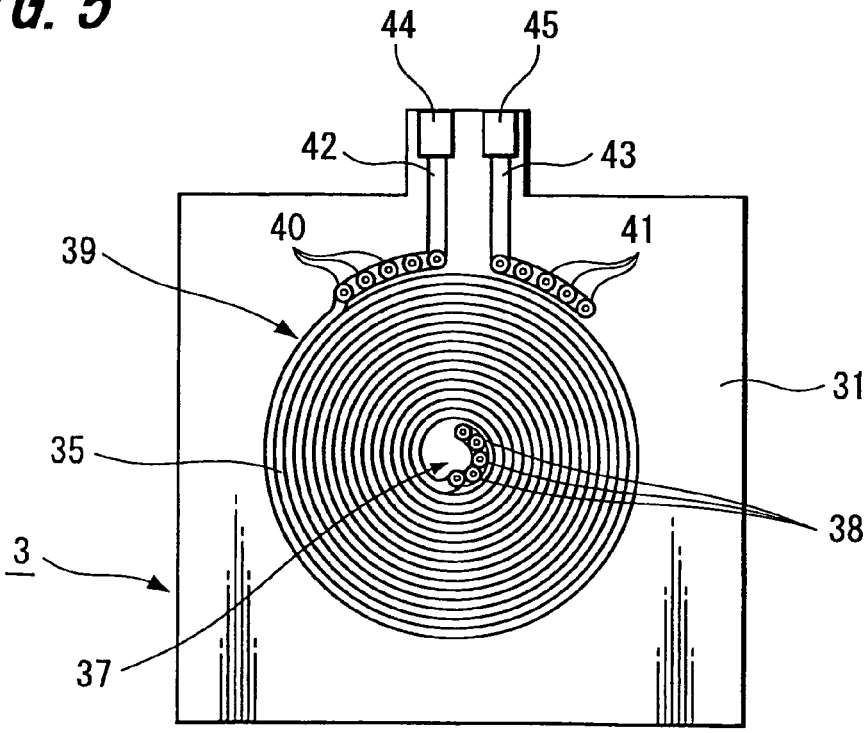
FIG. 5 is a view used for explaining the connections between the conductive patterns of a flat coil having a multilayer structure.

As shown in FIG. 5, pattern ends of inner periphery portions 37 of conductive patterns 35 on the first layer circuit board 31 to the fourth layer circuit board 34 are electrically connected via first through-holes 38. Similarly, pattern ends of outer periphery portions 39 of the conductive patterns 35 on the first layer circuit board 31 to the fourth layer circuit board 34 are electrically connected via second through-holes 40.

In addition, the first through-holes 38 on the inner periphery portion 37 side of the conductive patterns 35 on each layer are electrically connected to third through-holes 41 provided on the outer periphery portion 39 side of the conductive patterns 35 on each layer.

Also, the second through-holes 40 of the fourth layer circuit board 34, for example, are electrically connected via a second internal conductive pattern 42 to a second external connecting terminal portion 44. Similarly, the first through-holes 38 of the fourth layer circuit board 34 are electrically connected via the third through-holes 41 and a first internal conductive pattern 43 to a first external connecting terminal portion 45.

When a flat coil with a multilayer structure is used as the secondary side transfer coil 3, the flat coil is formed by the conductive patterns 35 of the flexible printed circuit boards 31 to 34 on each layer, and therefore the thickness can be made even slimmer than the flat coil that uses the wire 20 described earlier.

Attachment of the Coil Module Apparatus

Figure 6B:
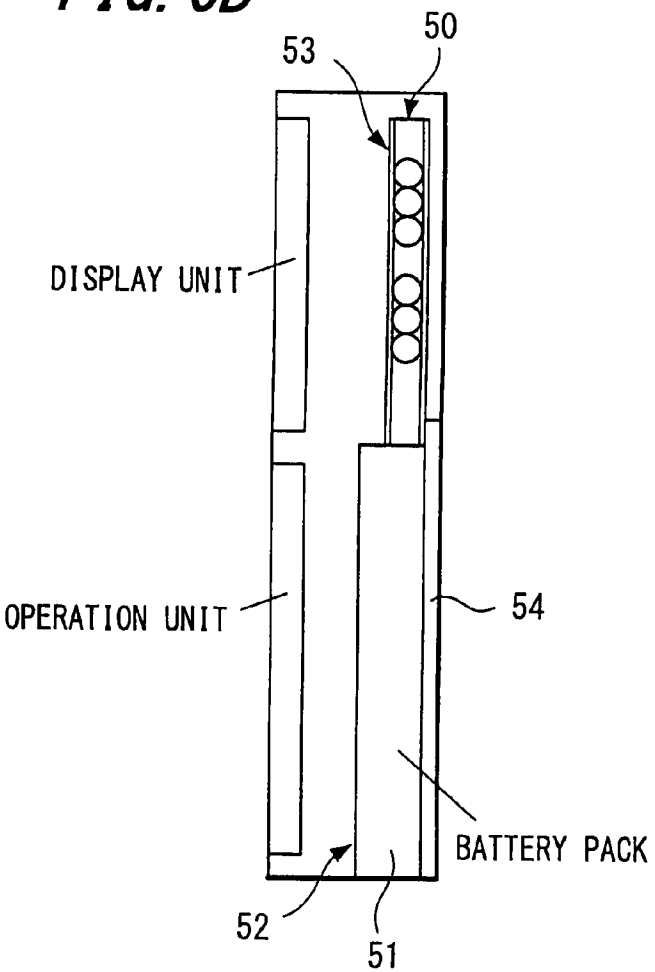
FIGS. 6A and 6B are views used for explaining a process of attaching the coil module apparatus according to the first embodiment of the present invention to a mobile phone unit.
Figure 6A:
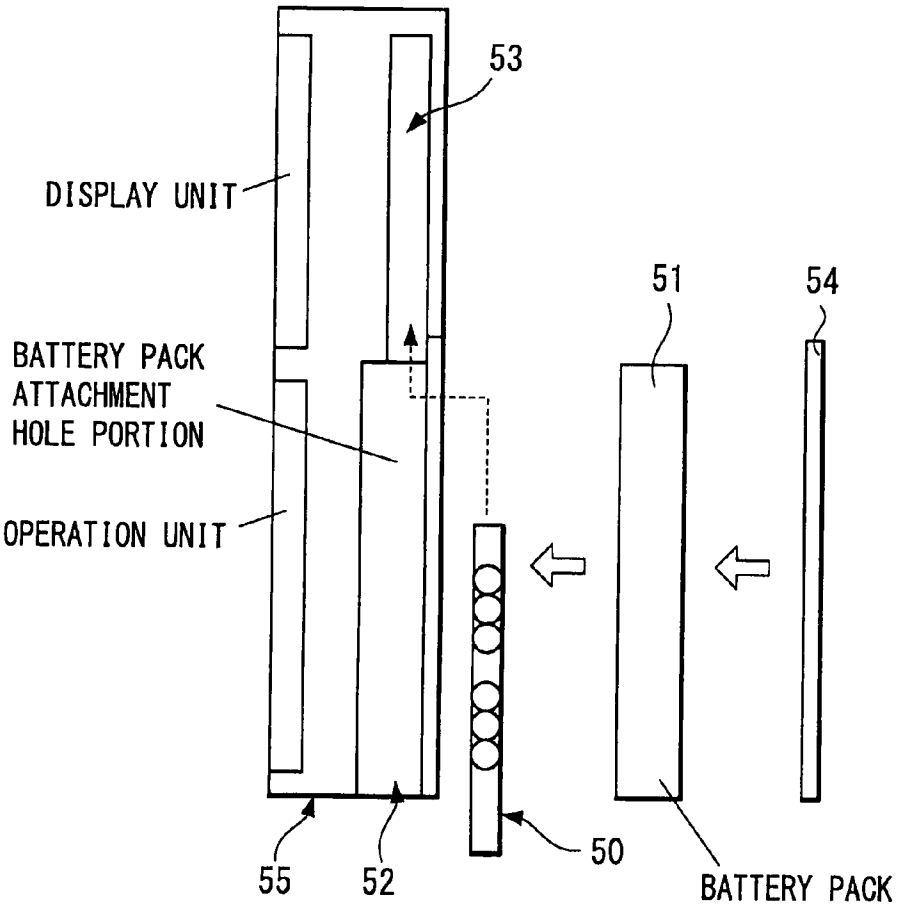

FIG. 6A is a cross-sectional view of a mobile phone unit in which a coil module apparatus 50 is installed. As one example, the mobile phone unit is a stick-shaped mobile phone unit and includes a battery pack attachment hole portion 52 that encloses a battery pack 51 on a rear surface of an operation unit and a coil module hole portion 53 that encloses the coil module apparatus 50 on a rear surface of a display unit.

When attaching the coil module apparatus 50 to such a mobile phone unit, a rear cover 54 of the mobile phone unit is removed. Subsequently, before the battery pack 51 is attached, the coil module apparatus 50 is inserted into the coil module hole portion 53 provided on the rear of the display unit as shown by the dotted arrow in FIG. 6A. By doing so, the connection terminals 10 provided on the coil module apparatus 50 and connection terminals provided on the mobile phone unit are in contact and electrically connected.

Next, the battery pack 51 is attached to the battery pack attachment hole portion 52 of the mobile phone unit and then the rear cover 54 is attached. By doing so, as shown in FIG. 6B, the coil module apparatus 50 is attached inside the mobile phone unit.

Note that the coil module apparatus 50 is attached to the rear surface of the display unit in this example. However, an insertion hole portion for the coil module apparatus 50 may instead be provided on a base surface portion 55 of the mobile terminal shown in FIG. 6A. Accordingly, by inserting the coil module apparatus 50 via this insertion hole portion, the coil module apparatus 50 can be attached between the battery pack 51 and the rear cover 54. Alternatively, the insertion hole portion of the coil module apparatus 50 may be provided on a side surface portion of the mobile phone unit and the coil module apparatus 50 may be attached via the insertion hole portion from the side surface portion of the mobile phone unit.

Effect of the First Embodiment

As is clear from the above description, in the coil module apparatus according to the first embodiment, the first case piece 1 and the second case piece 2 are placed facing one another and connected with the components from the secondary side transfer coil 3 to the metal sheet 9 enclosed therein to assemble a flat coil into a module. By doing so, the resistance to bending and the strength of a flat coil that has been made slim can be obtained with the first case piece 1 and the second case piece 2. Since the flat coil is provided as a module, when attached to a mobile phone unit, the coil module apparatus may only need to be inserted inside the mobile phone unit, so that the flat coil is incorporated in a simplified manner. Accordingly, the ease and productivity of the incorporating process can be improved.

Also, since a process that inserts the coil module apparatus into a charged appliance such as a mobile phone unit is sufficient as the incorporating process, it is possible to easily provide a contactless charging function to only charged appliances that may actually require such contactless charging function.

Second Embodiment

The first case piece 1 and the second case piece 2 are formed so as to enclose the components from the secondary side transfer coil 3 to the metal sheet 9 in the coil module apparatus according to the first embodiment. In contrast, a coil module apparatus according to a second embodiment is formed using a rear cover of a charged appliance, such as a mobile phone unit, as the first case piece 1 described above.

Note that parts of the coil module apparatus according to the second embodiment that are the same as those in the coil module apparatus according to the first embodiment described earlier have been assigned the same reference numerals in the drawings used to describe the coil module apparatus according to the second embodiment and duplicated description thereof is omitted.

Construction of Coil Module Apparatus According to Second Embodiment

Figure 7:
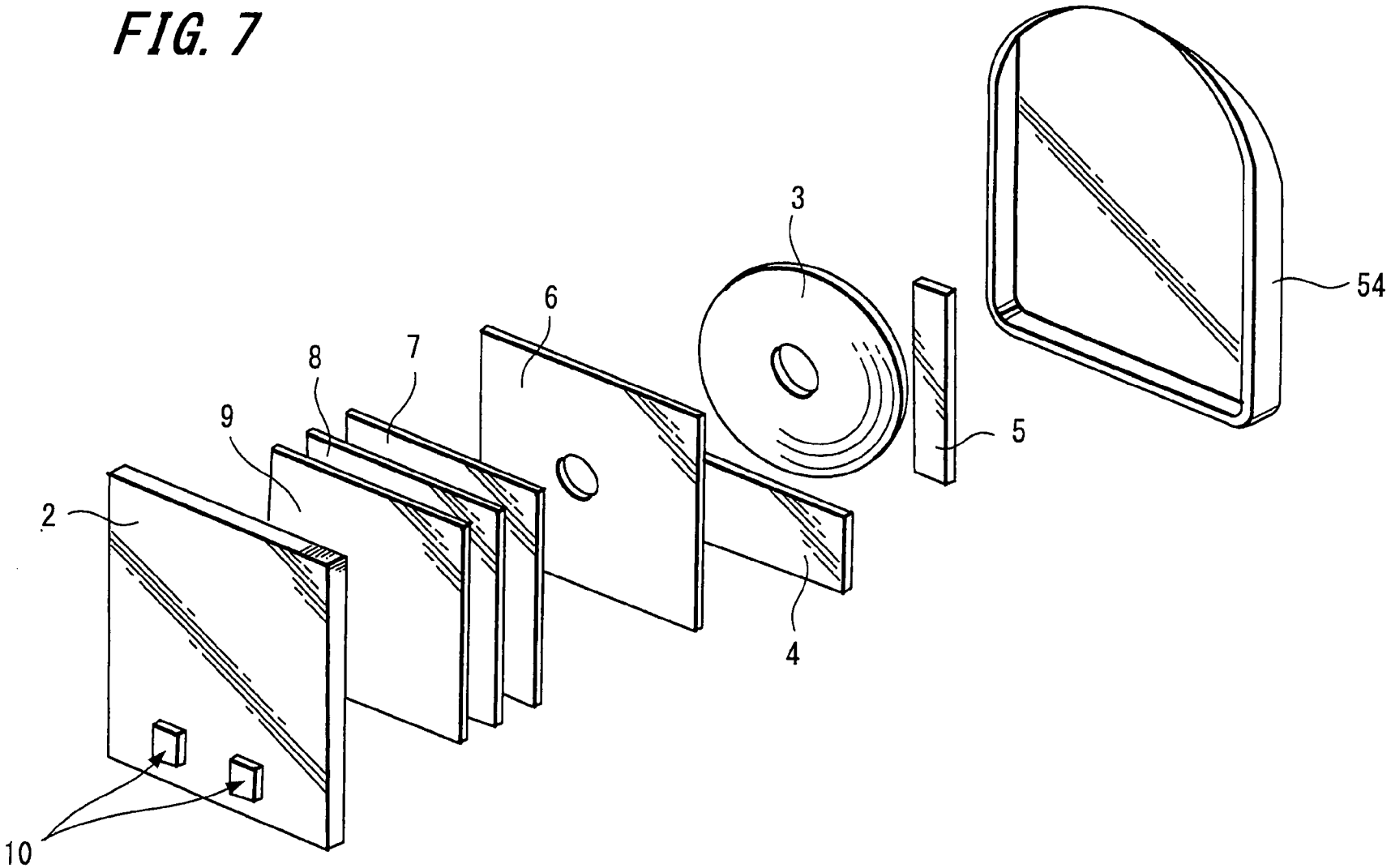
FIG. 7 is an exploded perspective view of a coil module apparatus according to a second embodiment of the present invention.
Figure 8:
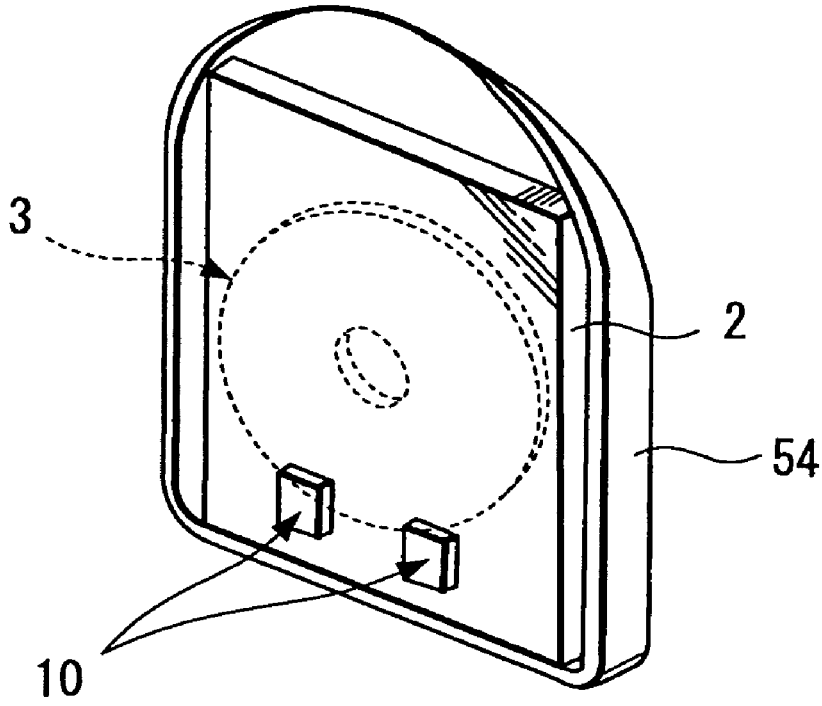
FIG. 8 is a perspective view of the coil module apparatus according to the second embodiment.

FIG. 7 is an exploded perspective view of the coil module apparatus according to the second embodiment and FIG. 8 is a perspective view of the coil module apparatus according to the second embodiment after assembly. As is understood from FIG. 7 and FIG. 8, the coil module apparatus according to the second embodiment is formed so that the components from the secondary side transfer coil 3 to the metal sheet 9 are enclosed by the rear cover 54 of the mobile phone unit shown in FIG. 6A and FIG. 6B and the second case piece 2 described above.

That is, the coil module apparatus according to the second embodiment uses the rear cover 54 of the mobile phone unit in place of the first case piece 1 described above. The coil module apparatus according to the second embodiment is formed so as to enclose components from the secondary side transfer coil 3 to the metal sheet 9 in an enclosure region internally formed by placing the rear cover 54 and the second case piece 2 facing one another.

Attachment of Coil Module Apparatus According to Second Embodiment

Figure 9B:
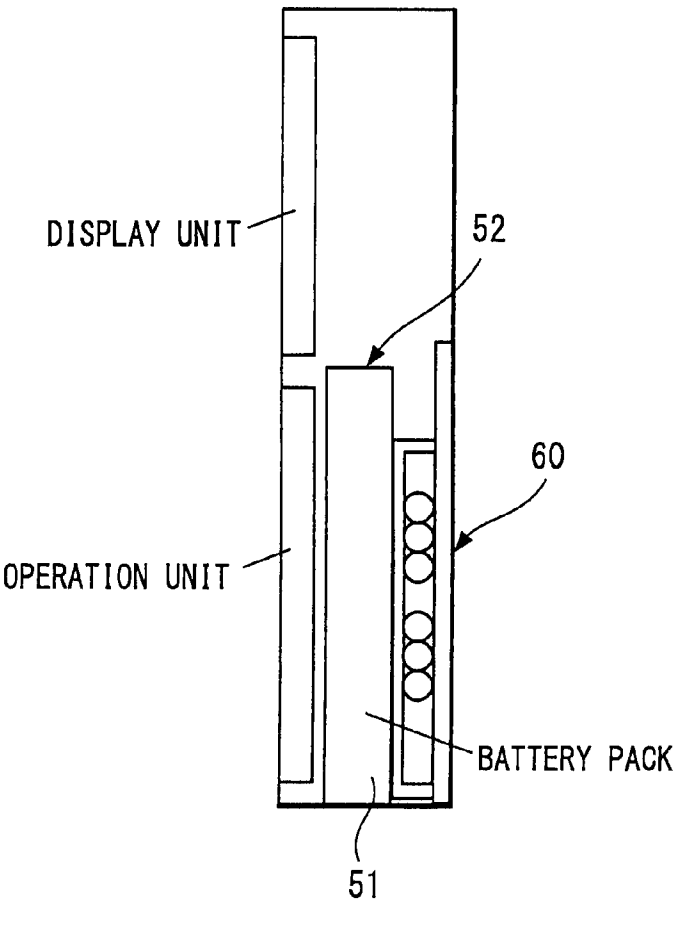
FIGS. 9A and 9B are views used for explaining a process of attaching the coil module apparatus according to the second embodiment of the present invention to a mobile phone unit.
Figure 9A:
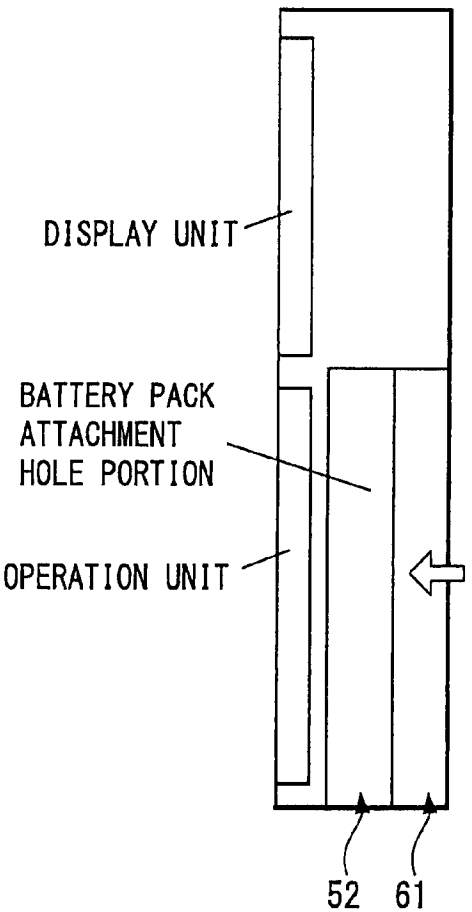

FIG. 9A is a cross-sectional view of a mobile phone unit to which a coil module apparatus 60 according to the second embodiment is attached. As one example, the mobile phone unit is a stick-shaped mobile phone unit, and includes, on a rear surface of an operation unit, a battery pack attachment hole portion 52 that encloses the battery pack 51 and a coil module gap portion 61 that encloses the coil module apparatus 60.

When the coil module apparatus 60 is attached to such a mobile phone unit, after the battery pack 51 has been attached to the battery pack attachment hole portion 52, the coil module apparatus 60 is attached to the mobile phone unit by attaching the rear cover to the mobile phone unit. By doing so, as shown in FIG. 9B, using the rear cover 54 in place of the first case piece 1 in addition to using it as the cover of the mobile phone unit, the coil module apparatus 60 is enclosed inside the coil module gap portion 61, thereby attaching the coil module apparatus to the mobile phone unit.

Effect of the Second Embodiment

As is clear from the above description, in the coil module apparatus according to the second embodiment, the first case piece 1 that forms the coil module apparatus is also used as the rear cover of a charged appliance such as a mobile phone unit, which makes it possible to reduce the number of components, in addition to achieving the same effect as the first embodiment described earlier.

MODIFICATIONS

Modifications of the embodiments described above will now be described. Note that the modifications described below may be individually or collectively applied to the coil module apparatuses of the embodiments described earlier.

First Modification

Figure 10A:
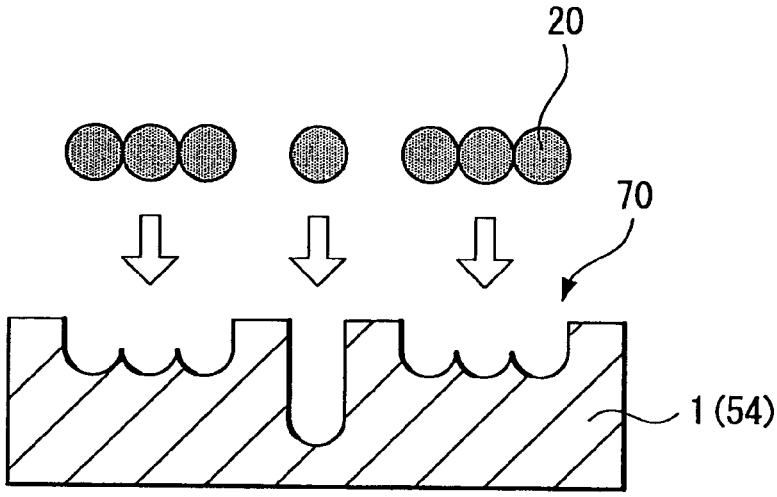
FIGS. 10A and 10B are views used for explaining a first modification where a groove portion into which the flat coil is fitted is formed in a case.
Figure 10B:
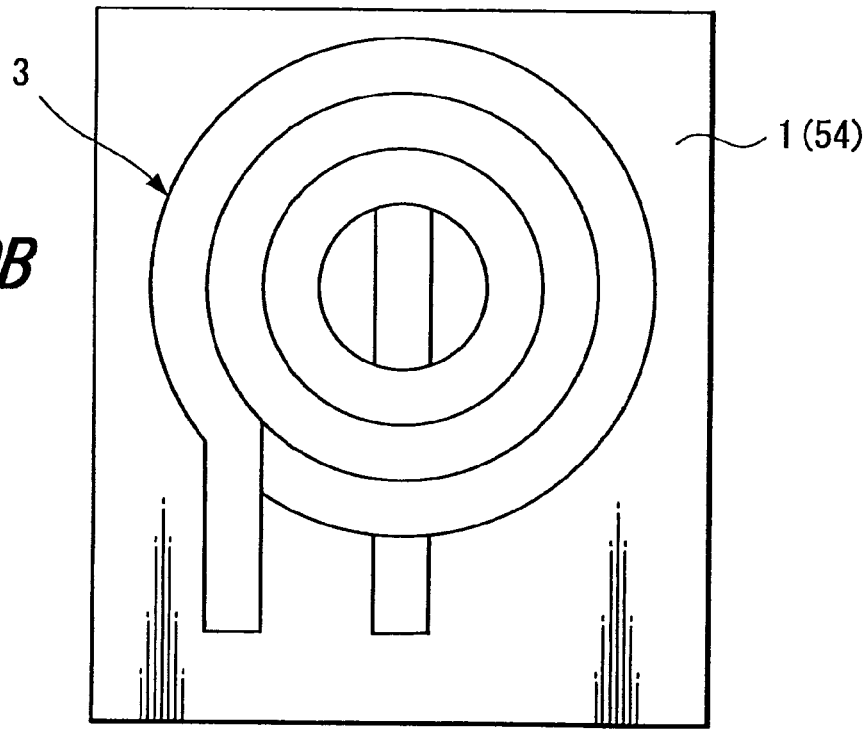

As shown in FIG. 10A and FIG. 10B, in the coil module apparatuses according to the embodiments described above, a groove portion 70 into which the secondary side transfer coil 3 is fitted may be provided on the first case piece 1 or on the rear cover 54 of the mobile phone unit (or charged appliance). The groove portion 70 is formed in accordance with the overall form of the secondary side transfer coil 3 formed by the wire 20. This means that by fitting the secondary side transfer coil 3 into the groove portion 70, the secondary side transfer coil 3 can be fixed to the first case piece 1 or the rear cover 54 with the secondary side transfer coil 3 correctly positioned. Also, with the groove portion 70, the positioning on the first case piece 1 or the rear cover 54 can be simplified.

Second Modification

Figure 11A:
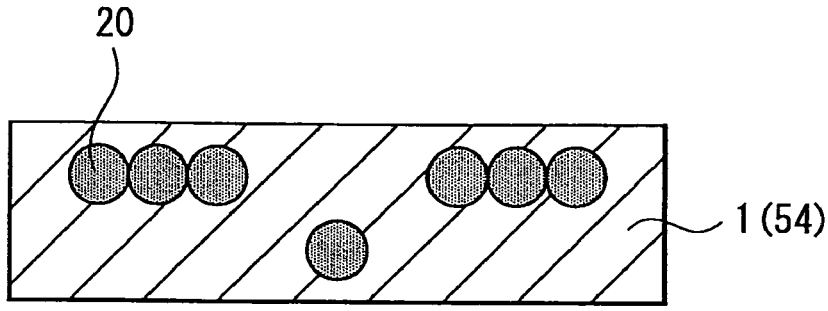
FIGS. 11A and 11B are views used for explaining a second modification where the flat coil is insert molded inside the case.
Figure 11B:
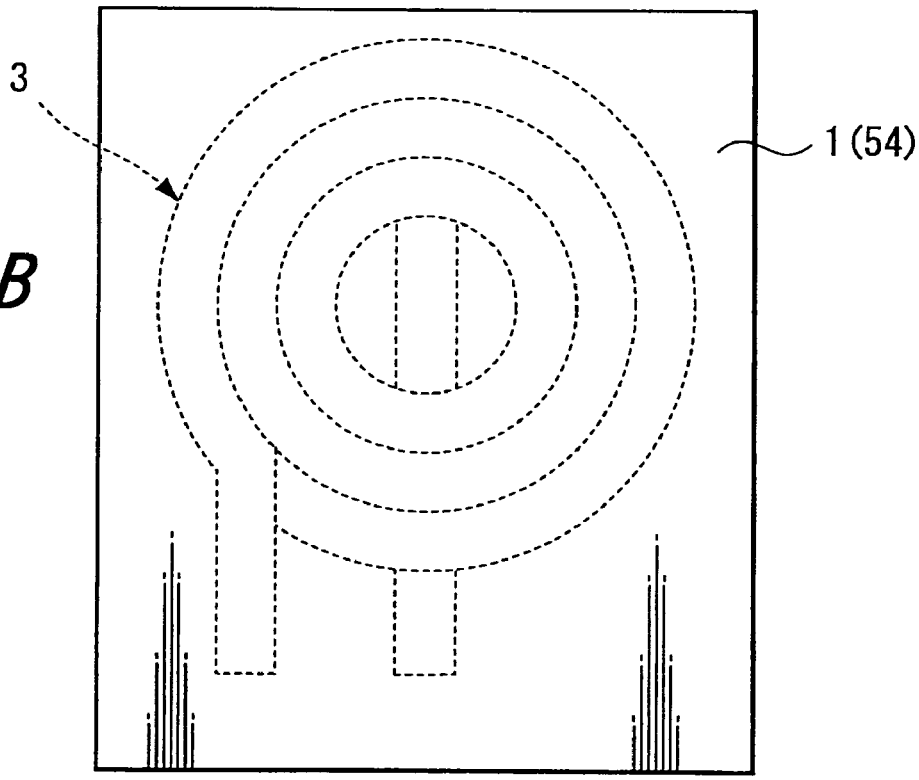

As shown in FIG. 11A and FIG. 11B, in the coil module apparatuses according to the embodiments described above, the secondary side transfer coil 3 may be insert molded inside the first case piece 1 or the rear cover 54 of the mobile phone unit (or charged appliance). By doing so, it is possible to fix the secondary side transfer coil 3 to the first case piece 1 or the rear cover 54 having correctly positioned the secondary side transfer coil 3 and to also prevent short circuits for the secondary side transfer coil 3. In addition, it is possible to omit a structure for positioning the secondary side transfer coil 3 that is provided on the first case piece 1 or the rear cover 54.

Third Modification

Figure 12A:
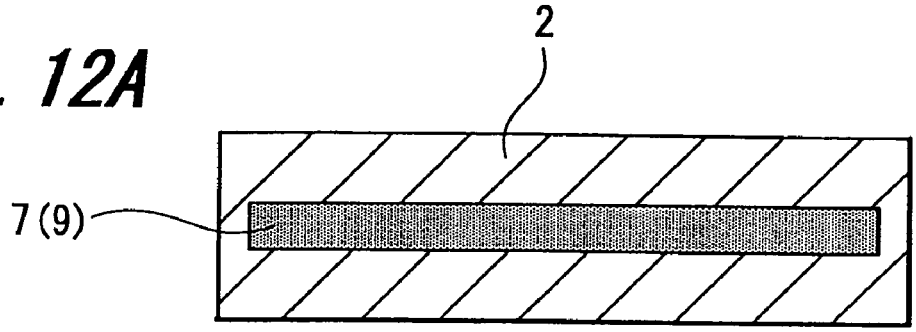
FIGS. 12A and 12B are views used for explaining a third modification where a magnetic sheet and/or metal sheet are insert molded inside the case.
Figure 12B:
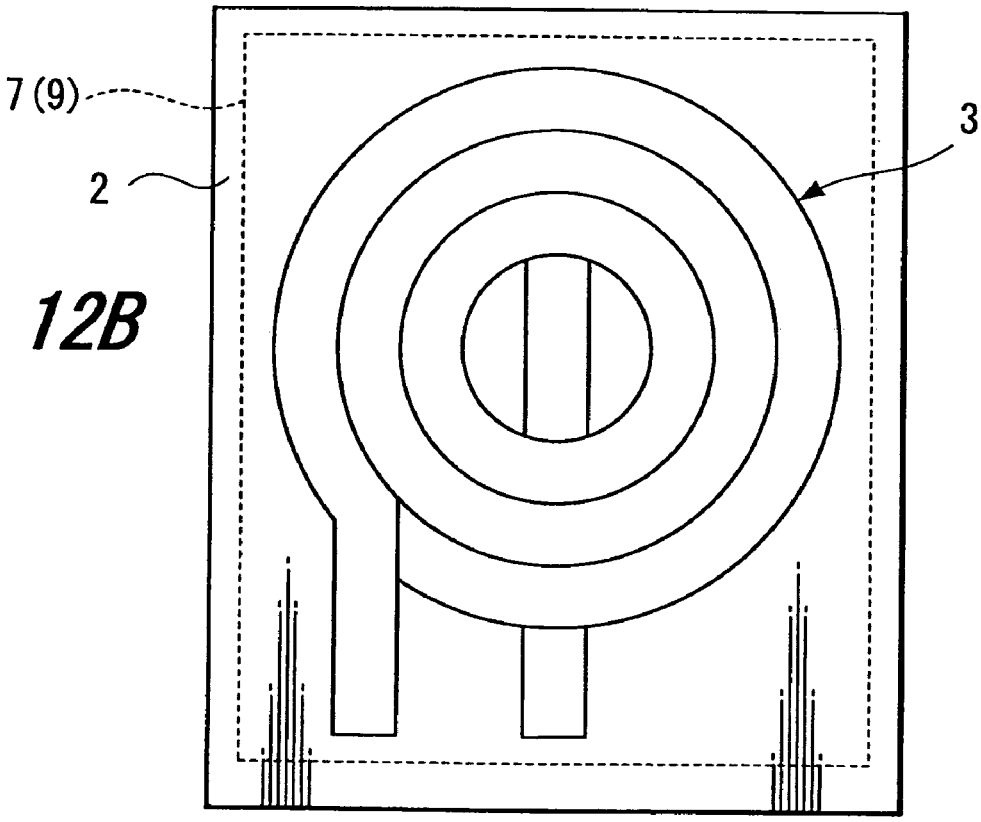

As shown in FIG. 12A and FIG. 12B, in the coil module apparatuses according to the embodiments described above, the magnetic sheet 7 and/or the metal sheet 9 may be insert molded inside the second case piece 2. By doing so, since the magnetic sheet 7 and the metal sheet 9 become sealed inside the second case piece 2, it is possible to prevent conductive particles from dispersing from the magnetic sheet 7 and the metal sheet 9.

Fourth Modification

Figure 13A:
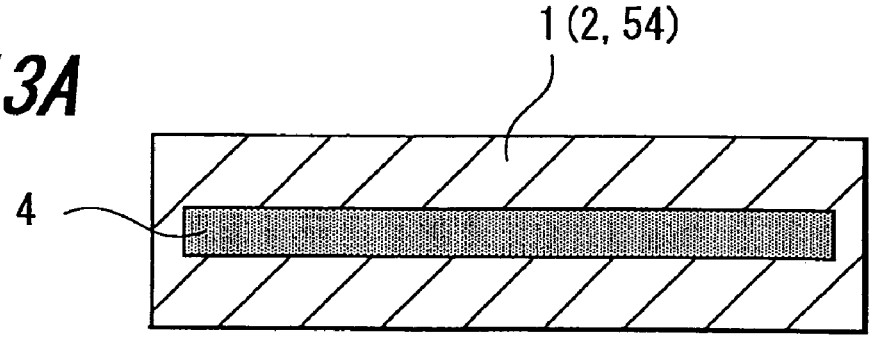
FIGS. 13A and 13B are views used for explaining a fourth modification where the circuit board is insert molded inside the case.
Figure 13B:
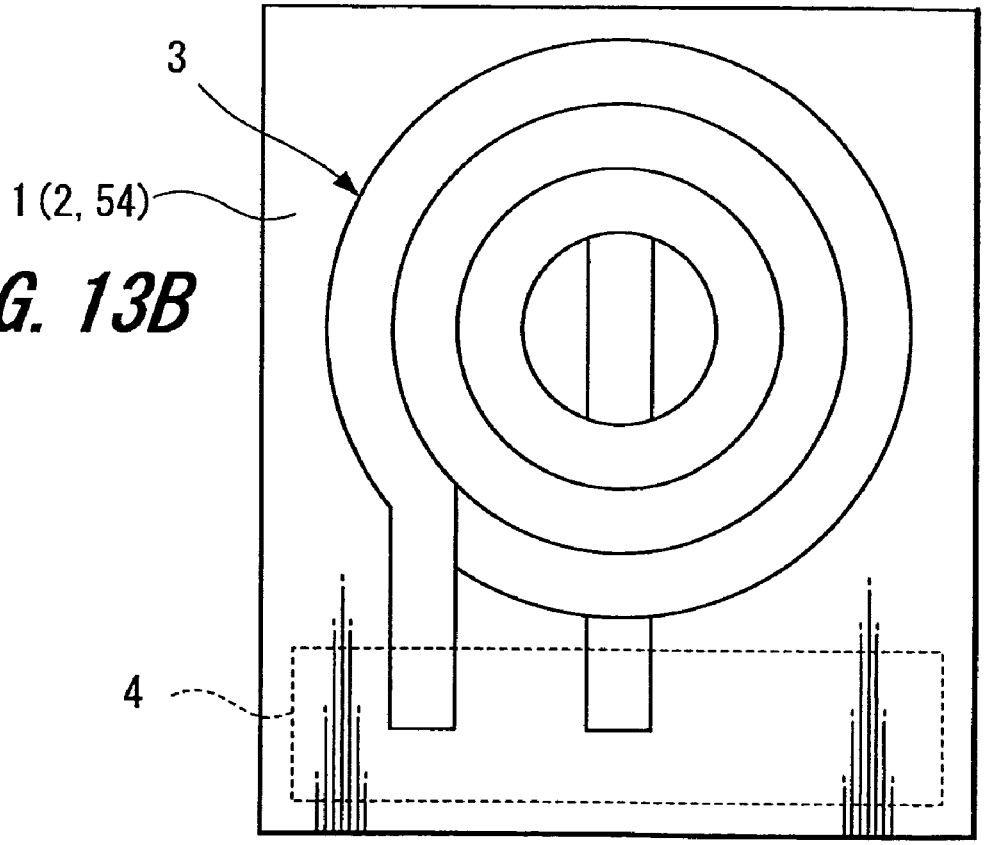

As shown in FIG. 13A and FIG. 13B, in the coil module apparatuses according to the embodiments described above, the circuit board 4 may be insert molded inside the first case piece 1, the second case piece 2, or the rear cover 54. By doing so, it is possible to easily position and dispose the circuit board 4, and since the circuit board 4 becomes sealed inside the first case piece 1, the second case piece 2, or the rear cover 54, it is possible to prevent short circuits for the circuit board 4.

Fifth Modification

Figure 14A:
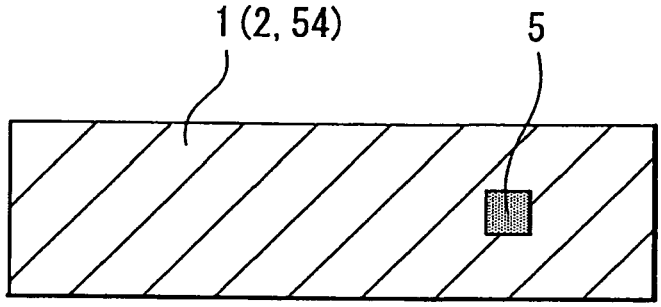
FIGS. 14A and 14B are views used for explaining a fifth modification where a temperature sensor is insert molded inside the case.
Figure 14B:
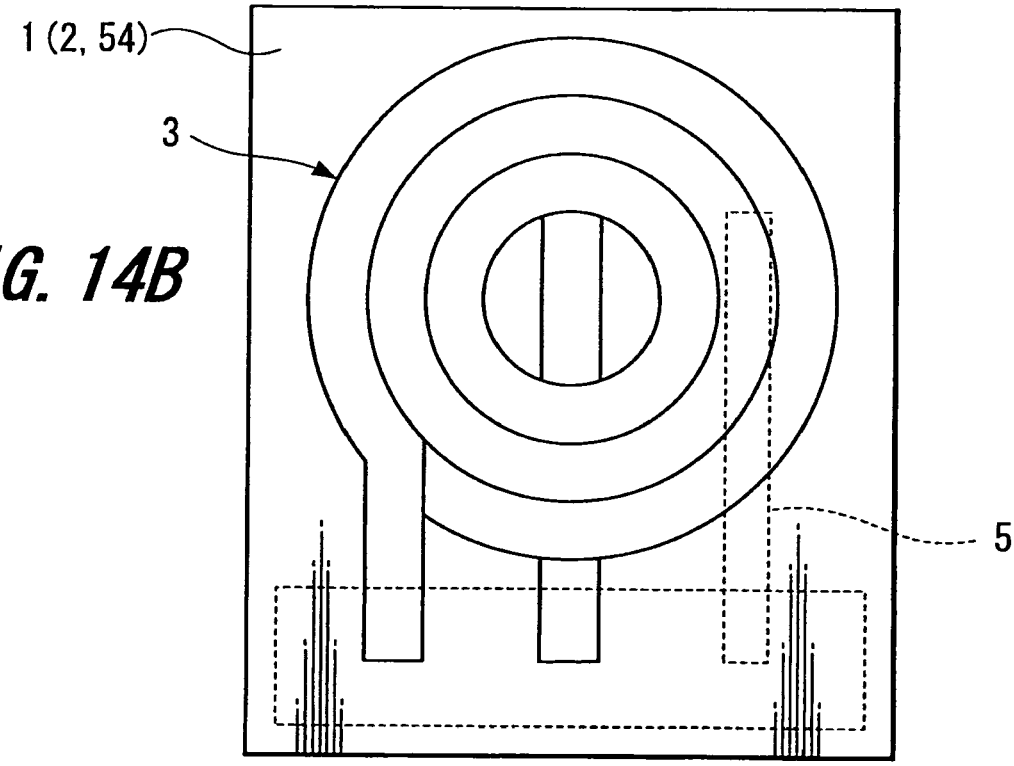

As shown in FIG. 14A and FIG. 14B, in the coil module apparatuses according to the embodiments described above, the temperature sensor 5 may be insert molded inside the first case piece 1, the second case piece 2, or the rear cover 54. By doing so, it is possible to easily position and dispose the temperature sensor 5, and since the temperature sensor 5 becomes sealed inside the first case piece 1, the second case piece 2, or the rear cover 54, it is possible to prevent short circuits for the temperature sensor 5.

Sixth Modification

Figure 15A:
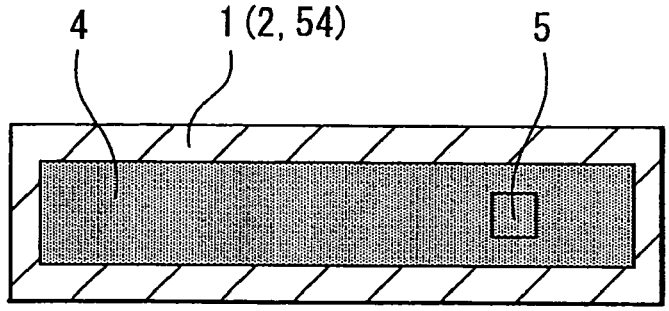
FIGS. 15A and 15B are views used for explaining a sixth modification where a temperature sensor is provided between any two layers of a multilayer circuit board and the multilayer circuit board provided with the temperature sensor is insert molded inside the case.
Figure 15B:
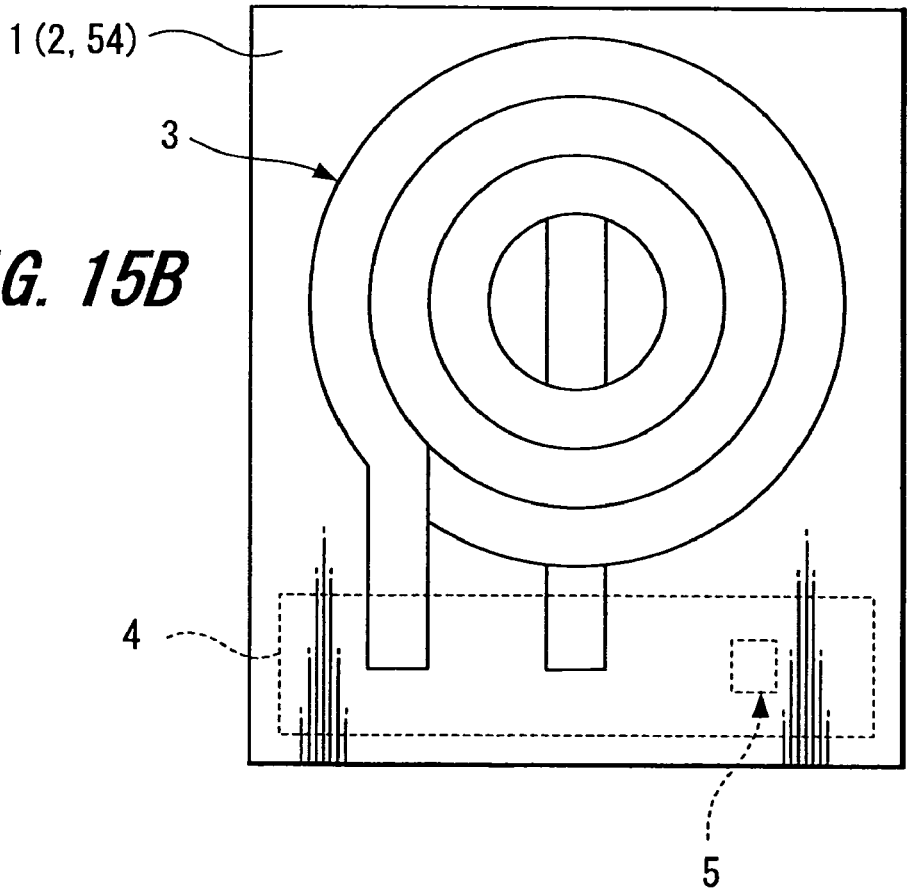

As shown in FIG. 15A and FIG. 15B, in the coil module apparatuses according to the embodiments described above, a multilayer circuit board may be used as the circuit board 4. The temperature sensor 5 may be provided between any of the layers of the multilayer circuit board, and the multilayer circuit board provided with the temperature sensor 5 may be insert molded inside the first case piece 1, the second case piece 2, or the rear cover 54. By doing so, it is possible to easily position and dispose the circuit board 4 and the temperature sensor 5, and since the circuit board 4 and the temperature sensor 5 become sealed inside the first case piece 1, the second case piece 2, or the rear cover 54, it is possible to prevent short circuits for the circuit board 4 and the temperature sensor 5.

Seventh Modification

Figure 16:
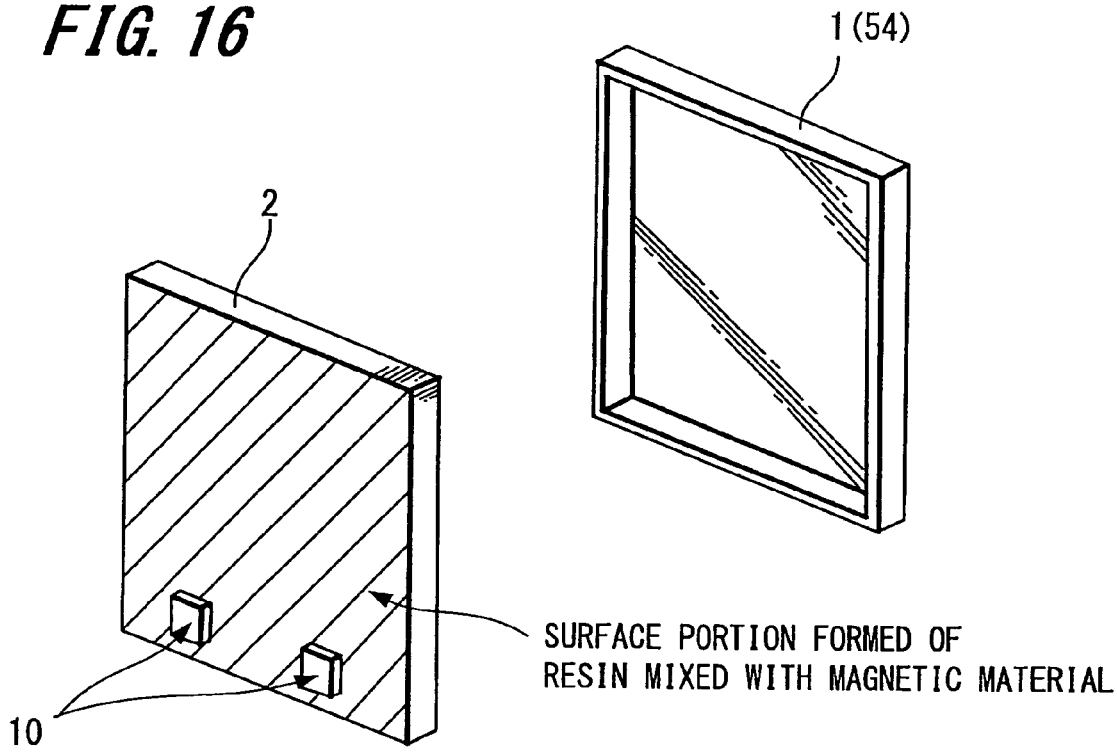
FIG. 16 is a view used for explaining a seventh modification where a surface portion of the case is formed of a resin in which a magnetic material is mixed.

As shown in FIG. 16, in the coil module apparatuses according to the embodiments described above, the entire second case piece 2 or a surface portion of the second case piece 2 that faces the secondary side transfer coil 3 may be formed of a resin in which a magnetic material is mixed. In this case, the magnetic sheet 7 shown in FIG. 1 or in FIG. 7 can be omitted, and therefore the coil module apparatus can be made even slimmer. Also, since a magnetic material is mixed into the resin, it is possible to prevent conductive particles from dispersing.

Eighth Modification

Figure 17:
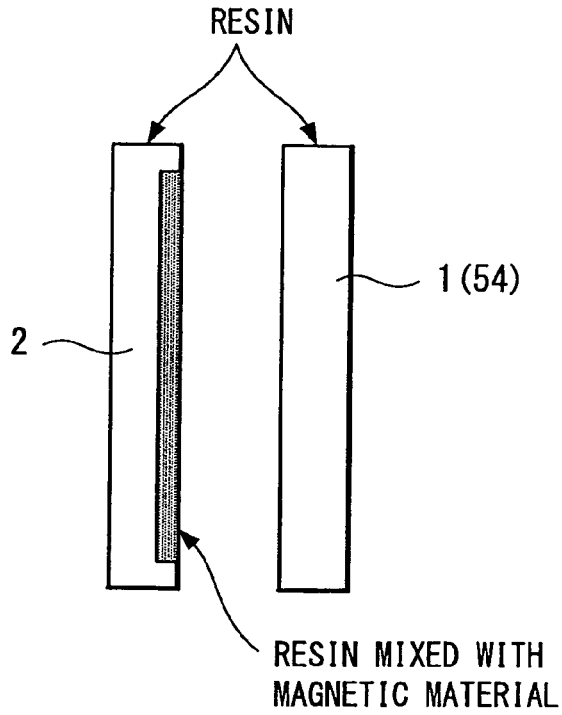
FIG. 17 is a view used for explaining an eighth modification where the case is dual-molded of a resin in which a magnetic material is mixed and a normal resin.

As shown in FIG. 17, in the coil module apparatuses according to the embodiments described above, the surface portion of the second case piece 2 that faces the secondary side transfer coil 3 may be formed of a resin in which a magnetic material is mixed and the other surface portion of the second case piece 2 may be formed of normal resin, or in other words, the second case piece 2 may be dual-molded. In this case, it is possible to omit the magnetic sheet 7 shown in FIG. 1 and FIG. 7, and therefore the coil module apparatus can be made even slimmer. Also, since the magnetic material is mixed into the resin, it is possible to prevent conductive particles from dispersing.

Ninth Modification

Figure 18:
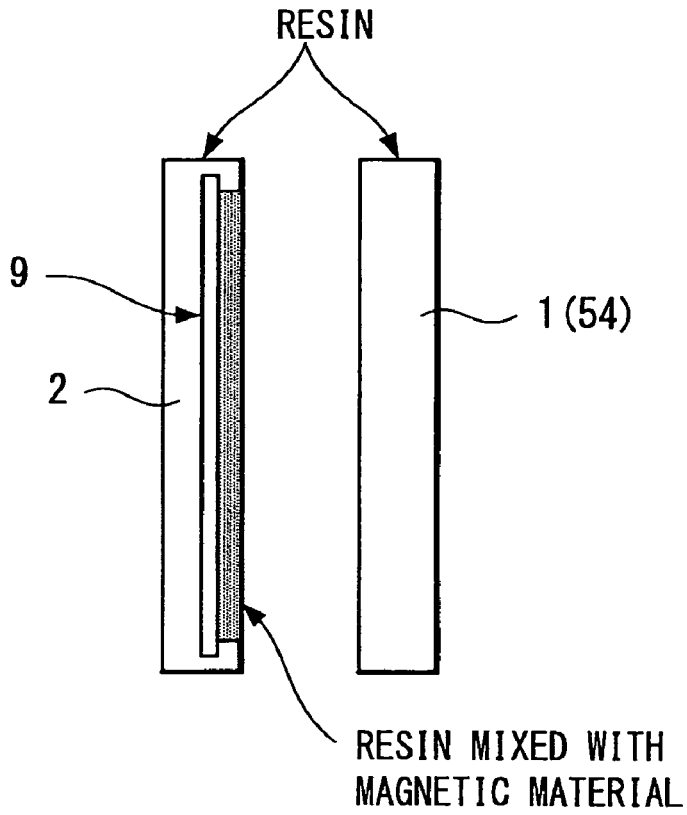
FIG. 18 is a view used for explaining a ninth modification where the case is dual-molded of a resin in which a magnetic material is mixed and a normal resin and where a metal sheet is insert molded.

As shown in FIG. 18, in the coil module apparatuses according to the embodiments described above, the surface portion of the second case piece 2 that faces the secondary side transfer coil 3 may be formed of a resin in which a magnetic material is mixed and the other surface portion thereof may be formed of normal resin. In other words, the second case piece 2 may be dual-molded. The metal sheet 9 may be insert molded inside the second case piece 2. In this case, the enclosure region of the case pieces 1 and 2 can be made smaller by an amount corresponding to the magnetic sheet 7 and the metal sheet 9, and therefore the coil module apparatus can be made even slimmer. Also, since a magnetic material is mixed into the resin and the metal sheet 9 is insert molded inside the second case piece 2, it is possible to prevent conductive particles from dispersing.

Tenth Modification

Figure 19:
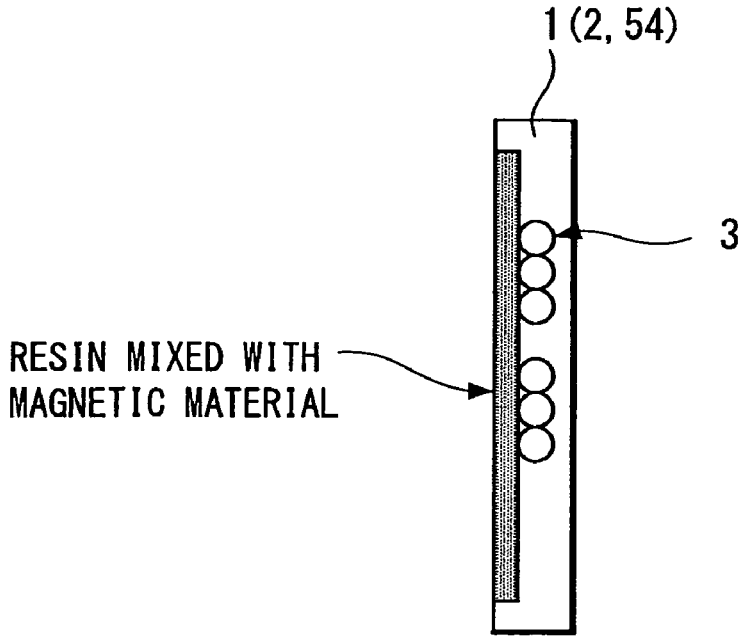
FIG. 19 is a view used for explaining a tenth modification where the case is dual-molded with a resin in which a magnetic material is mixed and a normal resin and where the secondary side transfer coil 3 is insert molded.

As shown in FIG. 19, in the coil module apparatuses according to the embodiments described above, the first case piece 1, the second case piece 2, or the rear cover 54 may be dual-molded of a resin in which a magnetic material is mixed and a normal resin, and the secondary side transfer coil 3 may be insert molded between the resin in which the magnetic material is mixed and the normal resin. By doing so, it is possible to obtain the effects of dual molding and the effects of insert molding the secondary side transfer coil 3 described above.

Eleventh Modification

Figure 20:
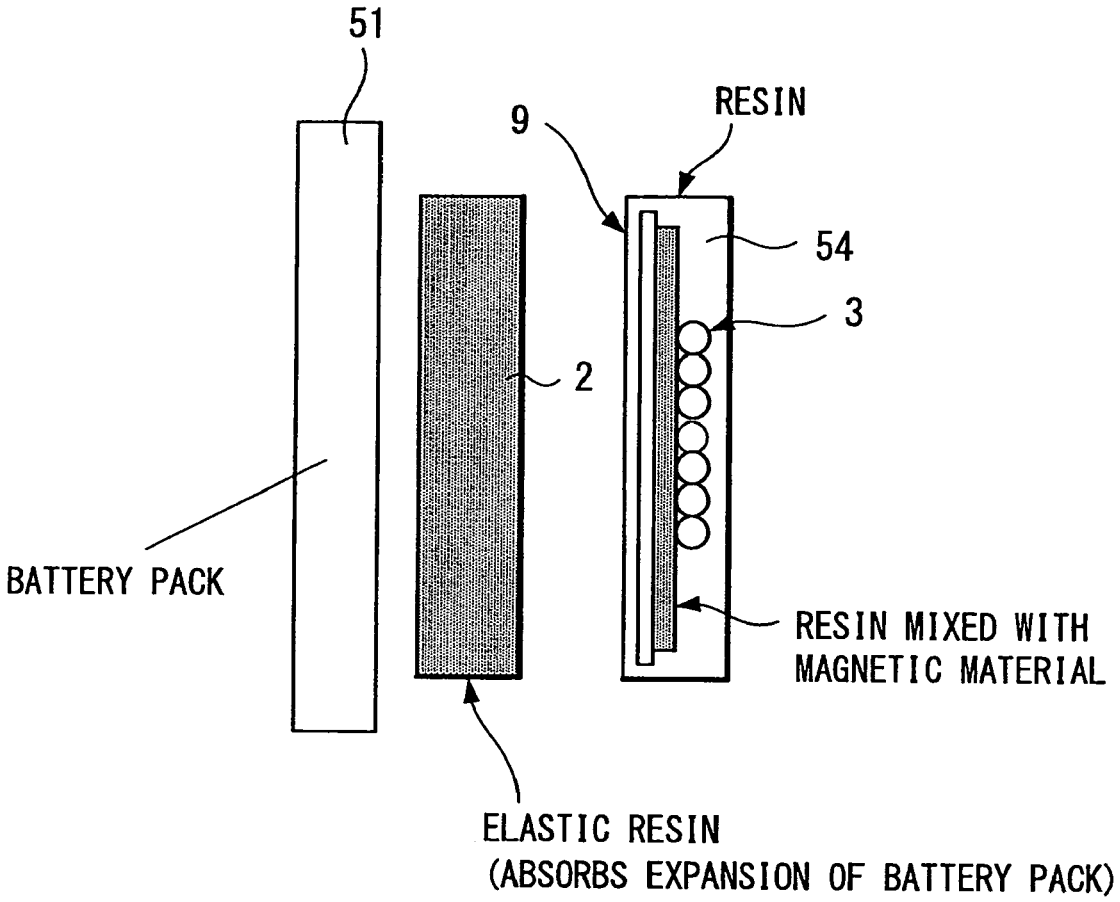
FIG. 20 is a view used for explaining an eleventh modification where the case is formed of elastic resin.

As shown in FIG. 20, in the coil module apparatuses according to the embodiments described above, the second case piece 2 may be formed of an elastic resin, i.e., a resin that exhibits elasticity. In the example shown in FIG. 20, the rear cover 54 (or the first case piece 1) is dual molded of the normal resin and the resin in which the magnetic material is mixed. The secondary side transfer coil 3 and the metal sheet 9 are insert molded, and the second case piece 2 formed of the elastic resin is connected to the rear cover 54.

It is known that the battery pack 51 will expand somewhat due to repeated charging. With the second case piece 2 that contacts the battery pack 51 being formed of elastic resin, it will be possible to absorb the expansion of the battery pack 51.

Although the present invention has been applied to a coil module apparatus of a mobile phone unit in the embodiments described above, the present invention can be applied to a coil module apparatus for a PHS (Personal Handyphone System) telephone, a PDA (Personal Digital Assistant), a mobile game device, a digital camera apparatus, or a notebook computer. By doing so, the same effects as described above can be obtained.

The embodiments and modifications described above are mere examples of the present invention and the present invention is not limited to such embodiments and modifications. It should therefore be understood by those skilled in the art that various modifications, combinations, sub-combinations and alterations may occur depending on design requirements and other factors insofar as they are within the scope of the appended claims or the equivalents thereof.

What is claimed is:

1. A coil module apparatus comprising:

a flat coil having a flat shape and defining a first plane;

a circuit board in electrical communication with the flat coil, the circuit board having a flat shape and defining a second plane;

a flat magnetic sheet provided so as to entirely cover one surface portion of the flat coil, the flat magnetic sheet defining a third plane;

connection terminals for electrically connecting the flat coil and the circuit board; and a case that encases the flat coil, the circuit board, and the magnetic sheet and partially encloses the connection terminals so that the connection terminals are partly exposed, wherein the first and second planes extend parallel to one another and are at least in facial contact with one another and the first and third planes extend parallel to one another in an adjacent yet spaced-apart manner.

2. A coil module apparatus according to claim 1, wherein the flat coil is one of:

a flat coil formed by winding a wire composed of one of a conductive single wire and a conductive twisted wire into a spiral on a substantially flat plane, and a flat coil formed by stacking a plurality of conductive pattern circuit boards, on which conductive patterns that each form part of the flat coil are formed, so that a spiral flat coil pattern is formed of the conductive patterns and electrically connecting the conductive patterns.

3. A coil module apparatus according to claim 1, wherein the flat coil enclosed in the case is a flat coil formed by winding a wire composed of one of a conductive single wire and a conductive twisted wire into a spiral on a substantially flat plane, and the case includes a flat coil insertion portion in the form of a groove with a shape that matches the flat coil and is provided in a surface portion contacted by the flat coil.

4. A coil module apparatus according to claim 1, wherein the flat coil, which is formed by winding a wire composed of one of a conductive single wire and a conductive twisted wire into a spiral on a substantially flat plane, is insert molded inside one surface portion of the case.

5. A coil module apparatus according to claim 1, wherein the magnetic sheet is insert molded inside the case.

6. A coil module apparatus according to claim 1, wherein the magnetic sheet is integrally formed with one surface portion of the case by mixing a magnetic material into a predetermined resin that forms the one surface portion of the case.

7. A coil module apparatus according to claim 1, wherein the magnetic sheet is formed by mixing a magnetic material into a predetermined resin, and one surface portion of the case is dual molded of a resin that forms the one surface of the case and the magnetic sheet that is formed by mixing the magnetic material into the predetermined resin.

8. A coil module apparatus according to claim 7, wherein the flat coil is insert molded between the resin that forms the one surface portion of the case and the magnetic sheet that is formed by mixing the magnetic material into the predetermined resin.

9. A coil module apparatus according to claim 1, further comprising a metal sheet that is enclosed inside the case and is provided so as to cover the flat coil from above the magnetic sheet.

10. A coil module apparatus according to claim 9, wherein the metal sheet is insert molded inside the case.

11. A coil module apparatus according to claim 10, wherein the metal sheet is insert molded between resin that forms one surface portion of the case and the magnetic sheet which is formed by mixing a magnetic material into a predetermined resin.

12. A coil module apparatus according to claim 1, further comprising a temperature detecting unit that is enclosed inside the case and detects a temperature of the flat coil.

13. A coil module apparatus according to claim 12, wherein the temperature detecting unit is insert molded inside one surface portion of the case.

14. A coil module apparatus according to claim 1, wherein the circuit board is insert molded inside one surface portion of the case.

15. A coil module apparatus according to claim 14, wherein the circuit board insert molded in the case is composed of a multilayer circuit board and the temperature detecting unit is provided between any two layers of the multilayer circuit board.

16. A coil module apparatus according to claim 1, wherein a surface portion of the case that contacts a battery pack, which is provided in an appliance to which the coil module apparatus is attached, is formed of elastic resin.

17. A coil module apparatus according to claim 1, wherein a surface portion of the case that faces an opposite surface portion of the flat coil to the surface portion covered by the magnetic sheet is processed so as to be shaped as a rear cover of a charged appliance to which the coil module apparatus is attached.

* * * * *